US008281464B2

(12) United States Patent
Shen

(10) Patent No.: US 8,281,464 B2
(45) Date of Patent: Oct. 9, 2012

(54) BUCKLE

(75) Inventor: Wei-Hong Shen, Taipei (TW)

(73) Assignee: Giotto's Industrial Inc., New Taipei (TW)

( * ) Notice: Subject to any disclaimer, the term of this patent is extended or adjusted under 35 U.S.C. 154(b) by 297 days.

(21) Appl. No.: 12/814,538

(22) Filed: Jun. 14, 2010

(65) Prior Publication Data

US 2011/0107565 A1 May 12, 2011

(30) Foreign Application Priority Data

Nov. 11, 2009 (CN) ..... 2009 2 0260243 U

(51) Int. Cl.
*A44B 11/25* (2006.01)

(52) U.S. Cl. ..... 24/625; 24/615; 24/614; 70/58

(58) Field of Classification Search ..... 24/631, 24/614, 615, 625, 629, 630; 70/58
See application file for complete search history.

(56) References Cited

U.S. PATENT DOCUMENTS 2,446,951 A * 8/1948 Quilter ..... 24/609
4,912,950 A * 4/1990 Crowle ..... 70/58
5,311,649 A * 5/1994 Suh ..... 24/625
5,419,020 A * 5/1995 Murai ..... 24/625
5,533,240 A * 7/1996 Murai ..... 24/615
5,548,879 A * 8/1996 Wu ..... 24/625
6,560,830 B1 * 5/2003 Chi ..... 24/653
6,871,517 B2 * 3/2005 Bonelli et al. ..... 70/58
7,150,082 B2 * 12/2006 Beletsky ..... 24/625
7,219,406 B2 * 5/2007 Chui ..... 24/625
2004/0112098 A1 * 6/2004 Bonelli et al. ..... 70/58
2006/0243006 A1 * 11/2006 Christensen et al. ..... 70/58
2009/0100652 A1 * 4/2009 Mok ..... 24/625

* cited by examiner

*Primary Examiner* — Robert J Sandy
*Assistant Examiner* — Rowland D Do
(74) *Attorney, Agent, or Firm* — Chun-Ming Shih; HDLS IPR Services

(57) ABSTRACT

A buckle includes a first fastener and a second fastener. The second fastener has two hooks. The first fastener includes a socket, a locking piece disposed in the socket, and two first locking portions formed on the socket for mating with the hooks. The locking piece is slidingly connected in the socket to cooperate with the second fastener. When the first fastener is engaged with the second fastener, the locking piece enters the second fastener to restrict the movement of the second fastener, so that the second fastener cannot be released unless the locking piece is removed from the second fastener and the hooks of the second fastener are pressed. Thus, the second fastener can be released only when the locking piece is moved, thereby preventing a problem that the second fastener may be separated from the first fastener when the hooks of the second fastener are incautiously pressed. A user has to move the locking piece with one hand and presses the hooks with another hand. Thus, such an action performed by two hands is uneasy for a child, thereby generating a safety effect.

5 Claims, 4 Drawing Sheets

BUCKLE

BACKGROUND OF THE INVENTION

1. Field of the Invention

The present invention relates to an article for daily use, and in particular to a buckle.

2. Description of Prior Art

In general, when two ends of a belt of a camera, baggage or other device are needed to be connected to or disconnected from each other quickly, two fasteners mating with each other are often used. The two fasteners are referred to as a first fastener and a second fastener respectively hereinafter. The second fastener can be inserted into the first fastener and engaged therewith. The combination of the first fastener and the second fastener is called a buckle. When the first fastener is connected with the second fastener, the second fastener is pressed by the first fastener, so that the second fastener can be inserted into the first fastener deeply. Then, hooks on both sides of the second fastener will be locked by locking portions on both sides of the first fastener respectively by means of the plastic deformation of the hooks. When a user intends to separate the first fastener from the second fastener, the user can press a portion of hooks protruding from the locking portions inwardly, so that the hooks of the second fastener can be removed from the locking portions of the first fastener. However, the user may incautiously press the portion of the hook of the second fastener protruding from the locking portions of the first fastener, so that the second fastener may be removed from the first fastener undesirably. Especially when the buckle is used in a vertical orientation, the second fastener may slide out of the first fastener due to its gravity force. Even, the second fastener may be separated from the first fastener when the buckle is swung by a child. As a result, the articles received in a baggage or the camera connected to the buckle may be fallen into the ground to suffer damage.

SUMMARY OF THE INVENTION

In order to solve the above problems, an objective of the present invention is to provide a safety buckle.

The present invention is to provide a buckle, which includes a first fastener and a second fastener mating with the first fastener. The second fastener is provided with a hook. The first fastener includes a socket, a locking piece provided in the socket, and a first locking portion provided on the socket for engaging with the hook. The locking piece is slidingly provided in the socket for preventing the hook from removing from the first locking portion.

Preferably, the socket is provided with a push button connected to the locking piece for pushing the locking piece. The push button is provided with a button hook connected to the locking piece.

Preferably, the locking piece and the socket are in interference fit. The locking piece is connected to an elastic piece. One end of the elastic piece is mounted on the locking piece, while the other end thereof abuts the socket.

Preferably, the locking piece includes a pushing portion connected to the push button and two stoppers connected to both sides of the pushing portion. The stopper is located to cooperate with the second fastener. One end surface of the stopper is provided with an accommodating trough for receiving an elastic piece. The elastic piece is received in the accommodating trough and a portion of the elastic piece protrudes from the accommodating trough to abut the socket. The socket is provided therein with a guiding groove. The locking piece is mounted in the guiding groove and slides along the guiding groove.

Preferably, upper and lower surfaces of the pushing portion protrude from the stopper. The stopper includes a stopping body and a stopping boss protruding from the stopping body. The stopping boss is provided adjacent to the pushing portion. The stopping boss is provided on each side of the pushing portion and is located at a level higher that of one end surface of the pushing portion. The stopping boss and the pushing portion form a restricting trough. The pushing portion is provided with a button locking trough for mating with the push button.

Preferably, the stopper is provided with a stopping strip. A mounting groove is formed between the stopping strip and the pushing portion. One end surface of the stopping body and the stopping boss together cooperate with the second fastener. One end surface of the stopping body cooperating with the second fastener is provided into a slope.

Preferably, the socket is of a hollow structure with an open end. The socket includes an upper wall, a lower wall, a left side wall, a right side wall, and a rear wall. The guiding grooves are formed in pairs by a guiding strip protruding from the inner surface of each of the upper wall and the lower wall. The guiding strip is received in the mounting groove. The mounting groove moves along the guiding strip. The first locking portion is an opening formed on a waist portion of the first fastener, and the opening extends from the left side wall or the right side wall to the upper wall or the lower wall. The first locking portion is provided with an engaging wall for mating with the hook. The upper wall or the lower wall is provided with a button trough for receiving the push button. The button hook passes through the button trough to enter the button locking trough to be fixed therein. The push button moves along the button trough.

Preferably, the second fastener includes a connecting wall. Two hooks are symmetrically provided on the connecting wall. A post is provided between the two hooks on the connecting wall. The post slidingly cooperates with the guiding groove. The hook is provided with a barb for mating with the engaging wall.

Preferably, an end surface of the post is located to mate with the pushing portion. The engaging wall is a curved slope for mating with the barb. The post is provided with a reinforcement rib. A distal end of the socket is provided with a first connecting piece. A distal end of the second fastener is provided with a second connecting piece.

Preferably, a first elongate hole is formed between the first connecting piece and the rear wall. A second elongate hole is formed between the second connecting piece and the connecting wall. A pair of guiding grooves is provided on the inner surfaces of the upper wall and the lower wall. The stopping strips are provided on both sides of the pushing portion. A mounting groove is formed between the stopping strip and the pushing portion. The stopping strips are provided on the upper and lower surfaces of the stopper to correspond to the guiding grooves. Two push buttons are provided on the socket. Two elastic pieces are symmetrically provided in the socket. Two accommodating troughs are symmetrically provided in the locking piece for corresponding to the elastic pieces.

The first fastener has the locking piece moving in the socket to prevent the hooks of the second fastener from removing the first locking portions of the first fastener. When the first fastener is engaged with the second fastener, the locking piece is inserted into the second fastener to restrict the movement of the second fastener, so that the second fastener cannot be released unless the locking piece is removed from the second fastener and the hooks of the second fastener are pressed. Thus, the second fastener can be released only when the locking piece is moved, thereby preventing a problem that the second fastener may be separated from the first fastener when the hooks of the second fastener are incautiously pressed. A user has to move the locking piece with one hand and presses the hooks with another hand. Thus, such an action performed by two hands is uneasy for a child, thereby generating a safety effect.

DETAILED DESCRIPTION OF THE INVENTION

Figure 1:
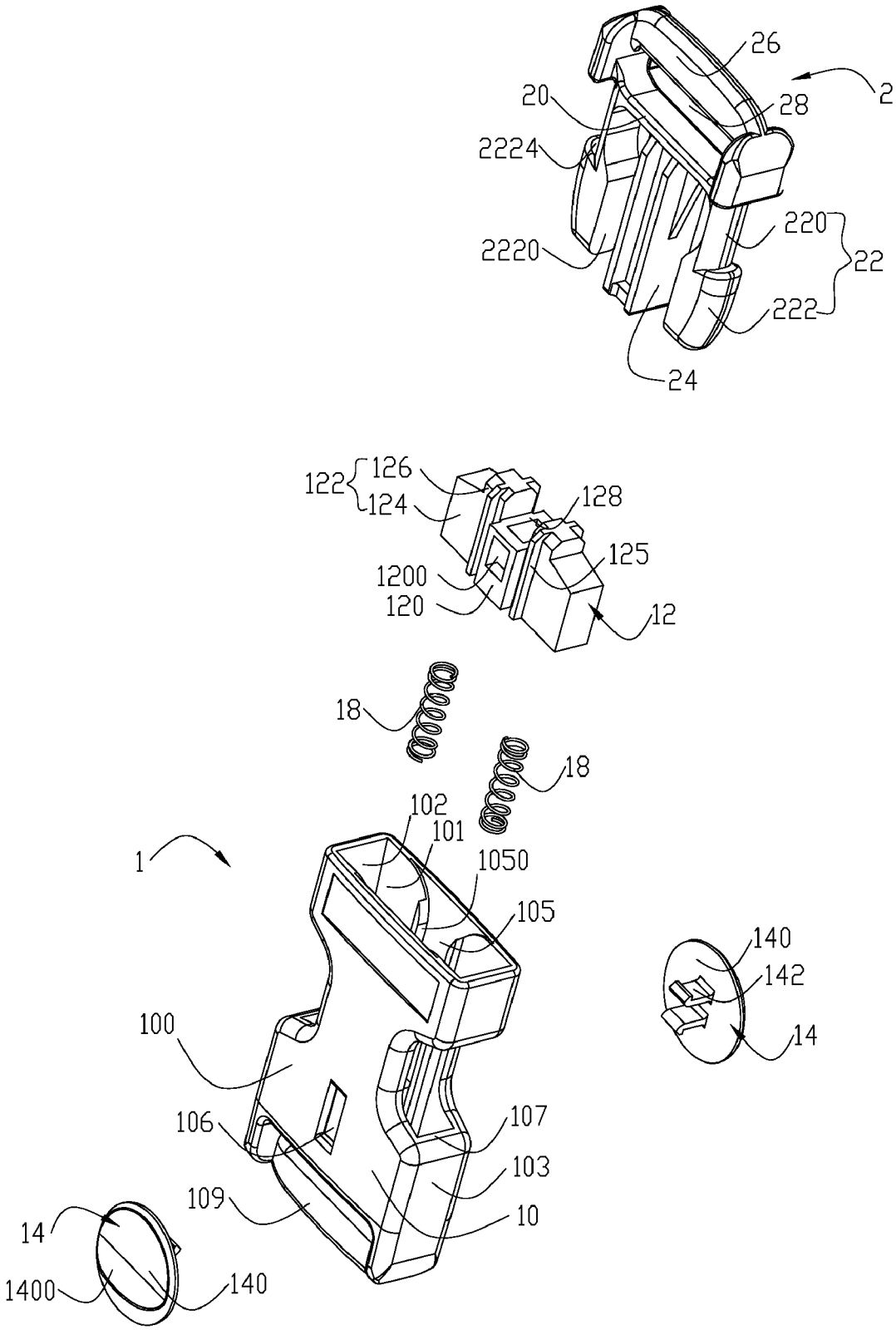
FIG. 1 is an exploded view showing an embodiment of the present invention.
Figure 2:
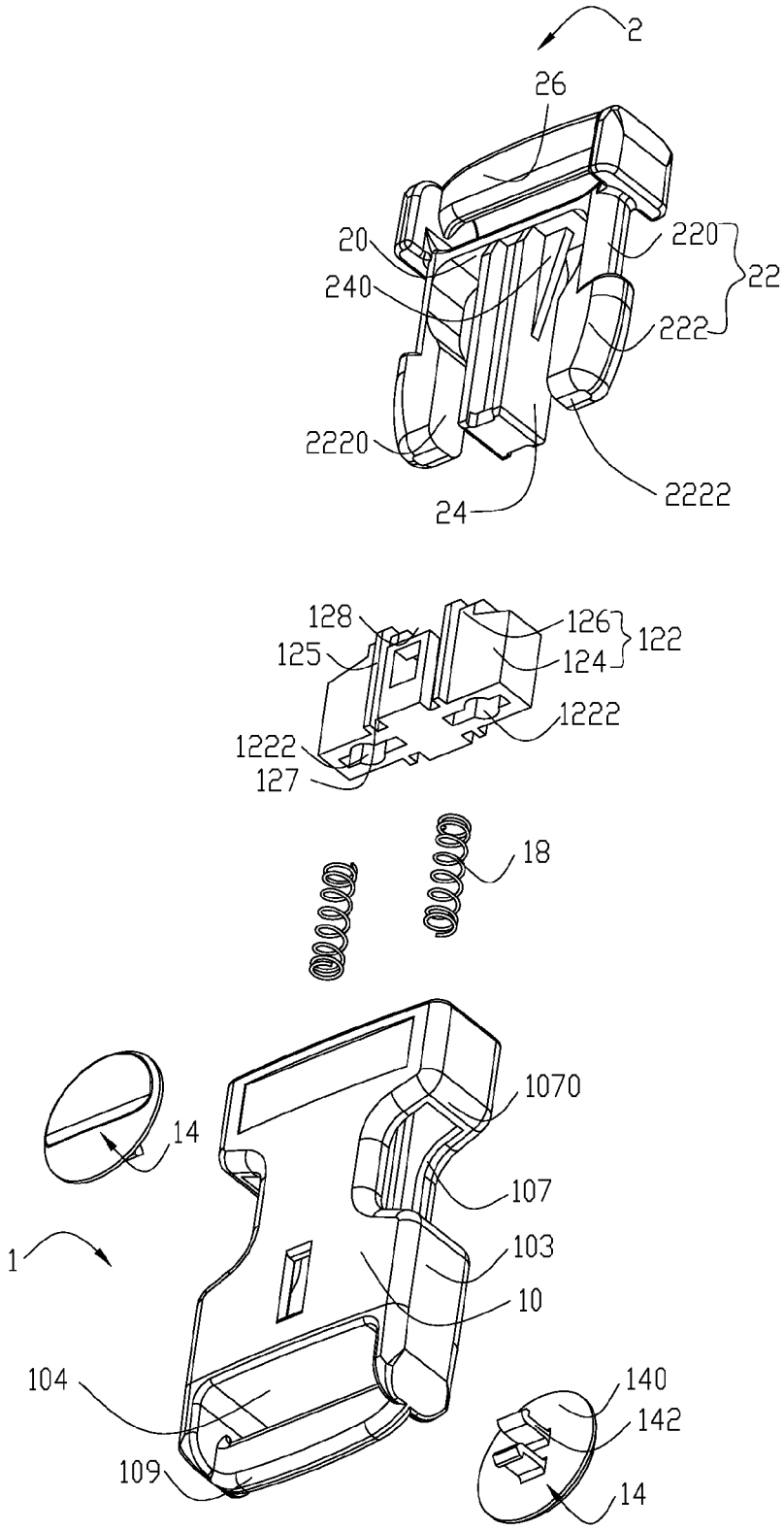
FIG. 2 is another exploded view showing the embodiment of the present invention.
Figure 3:
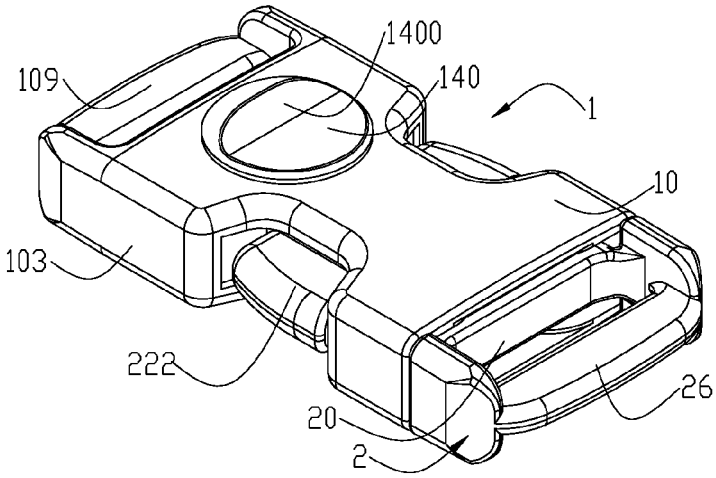
FIG. 3 is a schematic view showing the connection of a first fastener and a second fastener of the embodiment of the present invention.
Figure 4:
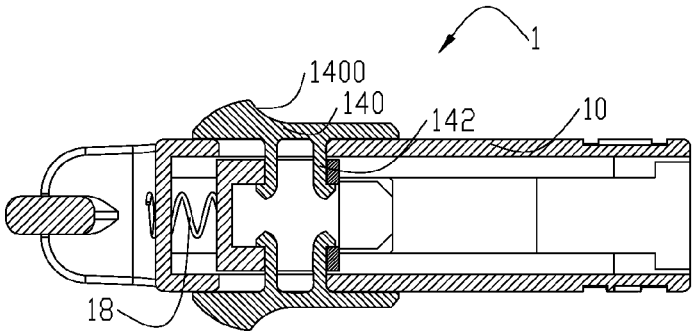
FIG. 4 is a cross-sectional view showing the embodiment of the present invention.
Figure 5:
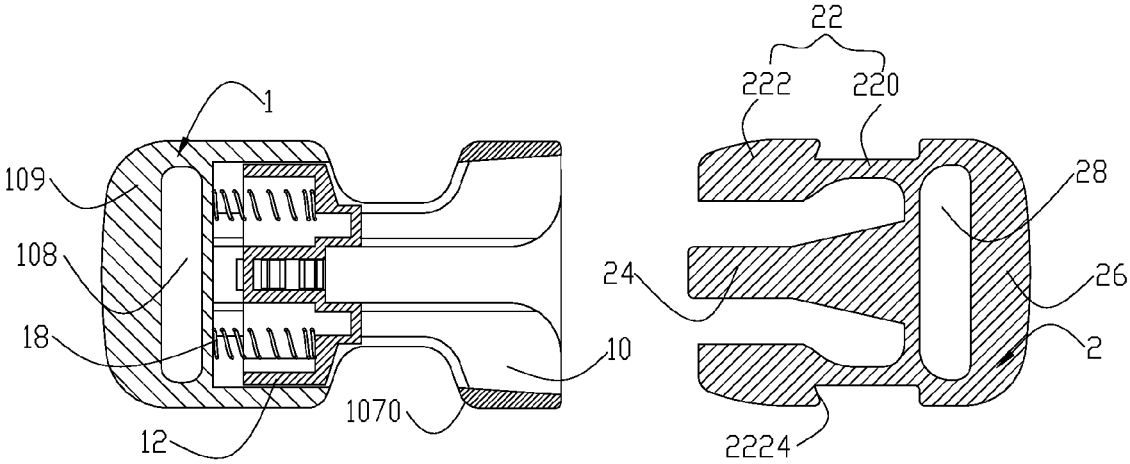
FIG. 5 is a schematic view showing the disconnection of the first fastener from a second fastener of the embodiment of the present invention.

The present invention will be described in more detail with reference to a preferred embodiment thereof shown in the accompanying drawings As shown in FIGS. 1 to 5. The buckle of the present invention includes a first fastener 1 and a second fastener 2 mating with the first fastener 1. The second fastener 2 includes a connecting wall 20, two hooks 22 formed on the connecting wall 20, a post 24 and a connecting piece 26 formed on the connecting wall 20.

The hooks 22 and the second connecting piece 26 are provided on both sides of the connecting wall 20, respectively. The second connecting piece 26 is formed on a distal end of each hook 22. A second elongate hole 28 is formed between the second connecting piece 26 and the connecting wall 20. The second connecting piece 26 is configured to connect to a belt. The belt passes through the second elongate hole 28 to be connected to the second connecting piece 26.

The hooks 22 are symmetrically formed on both ends of the connecting wall 20. Each of the hooks 33 includes a connecting portion 220 connected to the connecting wall 20, and a second locking portion 222 connected to the connecting portion 220.

The second locking portion 222 includes an open surface 2220 located inside, a second locking surface 2222, and a barb 2224 located outside to be engaged with the first fastener 1. The barb 2224 has a slope.

The post 24 is formed between the two hooks 22. Both sides of the post 24 are formed with a reinforcement rib 240 respectively. The hooks 22 and the post 24 formed between the two hooks 22 are connected to the connecting wall 20 to form a shape like a Chinese character "凵".

The first fastener 1 includes a socket 10, a locking piece 12 provided in the socket 10, and a push button 14 disposed on the socket 10 to be connected to the locking piece 12. The locking piece 12 is disposed in the socket 10 to move therein.

The socket 10 is of a hollow structure with an open end. The socket 10 is constituted of an upper wall 100, a lower wall 101, a left side wall 102, a right side wall 103, and a rear wall 104. The distal end of the socket 10 has a first connecting piece 109. A first elongate hole 108 is formed between the first connecting piece 109 and the rear wall 104.

The socket 10 has two guiding grooves 105 for mating with the post 24 of the second fastener 2. The two guiding grooves 105 are formed by two guiding strips 1050 protruding from the inner surfaces of the upper wall 100 and the lower wall 101 respectively. In the present invention, in order to guarantee the smooth movement of the second fastener 2 in the socket 10, the inner surfaces of the upper wall 100 and the lower wall 101 are provided with a pair of guiding strips 1050 respectively, thereby forming the pair of guiding grooves 105. The socket 10 is provided on the upper wall 100 or the lower wall 101 with a button trough 106 for receiving the push button 14. The push button 14 is movably mounted in the button trough 106.

The socket 10 is further formed with a first locking portion 107 for mating with the hooks 22 of the second fastener 2. The first locking portion is an opening formed on the waist portion of the first fastener 1. The first locking portions 107 are formed on the openings of the left side wall 102 and the right side wall 103 respectively, and the openings extend from the left side wall 102 and the right side wall 103 towards the upper wall 100 and the lower wall 101 respectively. The first locking portion 107 is provided with an engaging wall 1070 for engaging with the hook 22. The engaging wall 1070 is also formed with a slope for mating with the barb 2224 of the hook 22.

In the present embodiment, the upper wall 100 and the lower wall 101 of the socket 10 are mounted with a push button 14 respectively. The push button 14 includes a button body 140 and button hooks 142 connected to the button body 140. The button hooks 142 are inserted into the locking piece 12 and fixedly connected thereto. The button hooks 142 are connected to the locking piece 12 so as to drive the locking piece 12 to move together. In order to help the user to push the push button 14 easily, the upper surface of the button body 140 is formed with a convex surface 1400. When the user intends to press the push button 14, the user can press the convex surface 1400 of the button body 140 with his/her finger.

The locking piece 12 includes a pushing portion 120 connected to the push button 14 and two stoppers 122 connected to both sides of the pushing portion 120. The locking piece 12 is connected to elastic pieces, which are, for example, springs 18 in the present embodiment.

The upper and lower surfaces of the pushing portion 120 protrude from the stopper 122. The pushing portion 120 is formed with a button locking trough 1200 for engaging with the button hooks 142. Two button locking troughs 1200 are provided to correspond to the two push buttons 120 respectively on the upper and lower surfaces of the pushing portion 120. The button hooks 142 are received in the button locking trough 1200 and fixed therein. One end surface of the pushing portion 120 facing the second fastener 2 is located at a level lower than that of the stopper 122.

The stoppers 122 are symmetrically provided on both sides of the pushing portion 120. The upper surface or the lower surface of the stopper 122 is formed with a stopping strip 125. A mounting groove 127 is formed between the stopping strip 125 and the pushing portion 120. The upper surface or the lower surface of the stopper 122 and both sides of the pushing portion 120 is provided with a stopping strip 125. When the locking piece 12 is to be mounted, the mounting grooves 127 are aligned with the guiding strips 1050 of the socket 10, so that the guiding strips 1050 can be received in the mounting grooves 127. The locking piece 12 and the socket 10 are in interference fit. The outer surface of the locking piece 12 is profiled to correspond to the inner surface socket 10, so that the locking piece 12 can slide along the guiding strips 1050.

The stopper 122 includes a stopping body 124 and a stopping boss 126 protruding from the stopping body 124. One end surface of the stopping body 124 mating with the second fastener 2 is formed into a slope.

One end of the stopper 122 is further formed with an accommodating trough 1222 for receiving the spring 18. Two accommodating troughs 1222 are symmetrically formed on both sides of the pushing portion 120. Each of the accommodating troughs 1222 is configured to receive a spring 18 therein. Of course, more than one spring 18 can be received in the accommodating trough 1222. Thus, one end of the spring 18 is received in the accommodating trough 1222, and the other end thereof abuts the inner surface of the rear wall 104 of the socket 10, thereby providing a restoring force for the locking piece 12. The length of the spring 18 is larger than that of the accommodating trough 1222, so that a portion of the spring 18 can protrude from the accommodating trough 1222 to abut the inner surface of the rear wall of the socket 10.

The stopping boss 126 is provided adjacent to the pushing portion 120. The stopping bosses 126 are provided on both sides of the pushing portion 120 and are located at a level higher than that of the end surface of the pushing portion 120. A restricting trough 128 is formed between the stopping bosses 126 and the pushing portion 120.

Figure 6:
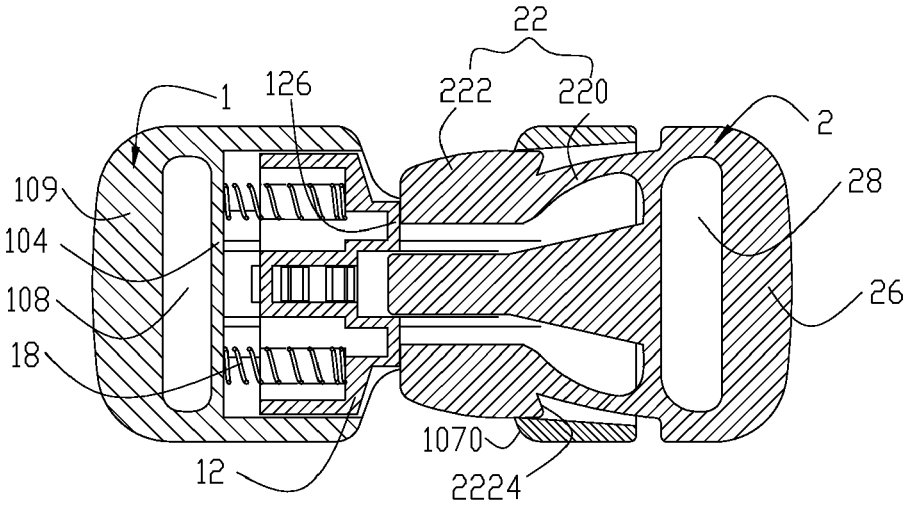
FIG. 6 is a schematic view showing a procedure of the insertion of the second fastener into the first fastener according to the embodiment of the present invention.
Figure 7:
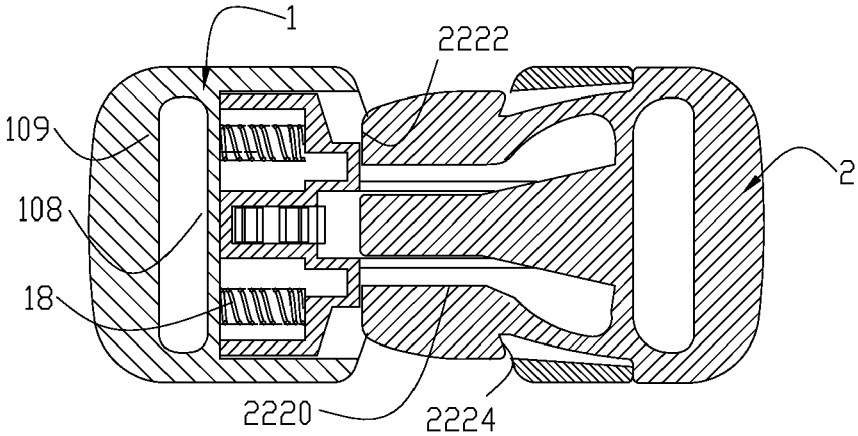
FIG. 7 is another schematic view showing the procedure of FIG. 6.
Figure 8:
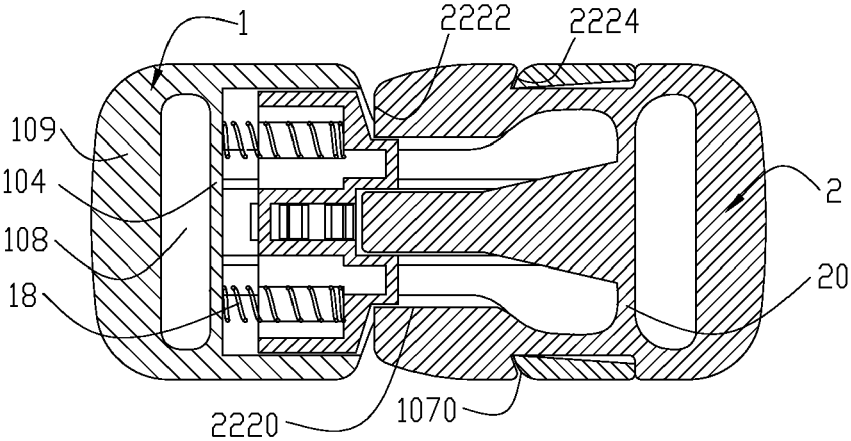
FIG. 8 is another schematic view showing the procedure of FIG. 7.

As shown in FIGS. 6 to 8, the post 24 of the second fastener 2 is received in the guiding grooves 105 of the socket 10 and is slidingly mated with the guiding grooves 105. When the first fastener 1 is engaged with the second fastener 2, the post 24 is inserted into the restricting trough 128 of the locking piece 12.

The hooks 22 of the second fastener 2 are engaged with the first locking portions 107 on both sides of the socket 10. The barb 2224 of the hook 2 is engaged with the engaging wall 1070. The engagement between the barb 2224 and the engaging wall 1070 is so strong that they cannot be detached from each other easily.

In a normal state, the distance between the open surfaces 2220 of the two hooks 22 is larger than the distance of the two stopping boss 126. The first fastener 1 is engaged with the second fastener 2. The stopping bosses 126 of the locking piece 12 are inserted into a space between the open surfaces 2220 of the hook 22 and the post 24.

The second fastener 2 is made of plastic materials. The distance between the two hooks 22 of the second fastener 2 is larger than the distance between the inner walls of the left side wall 102 and the right side wall 103 of the socket 10. When the second fastener 2 is inserted into the first fastener 1, the two hooks 22 of the second fastener 2 are pressed inwardly by the inner walls of the left side wall 102 and the right side wall 103 to generate an elastic deformation. As a result, the distance between the open surfaces 2220 of the two hooks 22 is compressed to be smaller than the distance between the two stopping bosses 126.

The post 24 enters the guiding grooves 105 and moves along the guiding grooves 105 until the second locking surfaces 2222 of the two hooks 22 of the second fastener 2 abut the end surfaces of the stopping bosses 126 respectively. At this time, the second fastener 2 pushes the locking piece 12 to move along the guiding grooves 105. The locking piece 12 moves to press the spring 18 and moves further into the socket 10 until the barbs 2224 of the two hooks 22 exceed the engaging walls 1070 of the left side wall 102 and the right side wall 103 of the socket 10. At this time, the two second locking portions 222 of the hooks 22 of the second fastener 2 will return to their original shape due to their elasticity if there is no external force. The hooks 22 on both sides of the second fastener 2 are engaged with the first locking portions 107 of the first fastener 1. The barb 2224 is engaged with the engaging wall 1070. Because of the reaction between the slope of the barb 2224 and the slope of the engaging wall 1070, the engagement between the first fastener 1 and the second fastener 2 becomes so strong that they cannot be detached from each other easily. Further, since the distance between the open surfaces 2220 of the two hooks 22 returns to its normal length, the distance between the open surfaces 2220 will be larger than the distance between the two stopping bosses 126. The second locking surface 2222 of the hook 22 no more abuts the end surface of the corresponding stopping boss 126, so that the external force for pressing the spring 18 is released. As a result, the spring 18 provides a restoring force to the locking piece 12, thereby making the locking piece 12 to return its original position. The locking piece 12 moves along the guiding grooves 105 to return its original position. The stopping bosses 126 of the locking piece 12 are inserted into the space between the open surfaces 2220 of the hook 22 and the post 24.

At this time, if the user presses the barb 2224 of the hook 22 of the second fastener 2 exposed to the opening of the first locking portion 107, the barb 2224 is blocked by the stopping boss 126 between the open surfaces 2220 and the post 24, so that the barb 2224 cannot be pressed inwardly any more. Further, the barb 2224 cannot be separated from the engaging wall 1070, thereby generating a safety effect.

When the user intends to separate the first fastener 1 from the second fastener 2, the user pushes the push button 14 toward the rear wall 104 of the socket 10. The push button 14 moves along the button trough 106 to drive the locking piece 12 to move close to the rear wall 104 of the socket 10. At the same time, the locking piece 12 presses the spring 18 until the stopping boss 126 of the locking piece 12 is removed from the space between the open surfaces 2220 of the hook 22 and the post 24. As a result, the first fastener 1 can be separated from the second fastener 2.

When the user presses again the barbs 2224 of the hook 22 of the second fastener 2 exposed to the opening of the first locking portion 107, the engagement between the slope of the barb 2224 and the slope of the engaging wall 1070 can be released. As a result, the user can pull the second fastener 2 in a direction away from the first fastener 1, whereby the second fastener 2 can be separated from the first fastener 1. At this time, the locking piece 12 returns to its original position by means of the restoring force of the spring 18.

Although the present invention has been described with reference to the foregoing preferred embodiment, it will be understood that the invention is not limited to the details thereof. Various equivalent variations and modifications can still occur to those skilled in this art in view of the teachings of the present invention. Thus, all such variations and equivalent modifications are also embraced within the scope of the invention as defined in the appended claims.

What is claimed is:

1. A buckle, including a first fastener and a second fastener mating with the first fastener, wherein the second fastener has a hook, the first fastener has a socket, a locking piece being provided in the socket, a first locking portion being formed on the socket to be engaged with the hook, wherein the locking piece is slidingly mounted in the socket to prevent the hook from separating from the first locking portion, wherein the socket is mounted with a push button connected to the locking piece for pushing the locking piece, and the push button has a button hook connected to the locking piece, wherein the locking piece and the socket are in interference fit, the locking piece is connected with an elastic piece, one end of the elastic piece is mounted on the locking piece, and the other end thereof abuts the socket, wherein the locking piece includes a pushing portion connected to the push button and a stopper connected to the pushing portion and formed on both sides of the pushing portion, the stopper is positioned to cooperate with the second fastener, one end surface of the stopper is formed with an accommodating trough for receiving an elastic piece, the elastic piece is received in the accommodating trough with a portion thereof protruding from the accommodating trough to abut the socket, the socket has a guiding groove, and the locking piece is mounted in the guiding groove to slide along the guiding groove, wherein an upper surface and a lower surface of the pushing portion protrude from the stopper, the stopper includes a stopping body and a stopping boss protruding from the stopping body, the stopping boss is positioned adjacent to the pushing portion, the stopping boss is formed on each side of the pushing portion and located at a level higher than that of one end surface of the pushing portion, the stopping boss and the pushing portion form a restricting trough, and the pushing portion has a button locking trough for mating with the push button, and wherein the stopper has a stopping strip, a mounting groove is formed between the stopping strip and the pushing portion, one end surface of the stopping body and the stopping boss are positioned to cooperate with the second fastener, and one end surface of the stopping body cooperating with the second fastener is formed into a slope.

2. The buckle according to claim 1, wherein the socket is a hollow structure with an open end, the socket includes an upper wall, a lower wall, a left side wall, a right side wall, and a rear wall, the guiding grooves are formed in pairs by a guiding strip protruding from the inner surface of each of the upper wall and the lower wall, the guiding strips are received in the mounting groove, the mounting groove moves along the guiding strips, the first locking portion is an opening formed on a waist portion of the first fastener, the opening extends from the left side wall or the right side wall to the upper wall or the lower wall, the first locking portion has an engaging wall for mating with the hook, the upper wall or the lower wall has a button trough for receiving the push button, the button hook passes through the button trough to be fixed therein, and the push button moves along the button trough.

3. The buckle according to claim 2 wherein the second fastener includes a connecting wall, two hooks are symmetrically formed on the connecting wall, a post is formed between the two hooks on the connecting wall, the post is configured to slidingly cooperate with the guiding groove, and the hook has a barb for engaging with the engaging wall.

4. The buckle according to claim 3, wherein an end surface of the post is engaged with the pushing portion, the engaging portion is formed into a curved slope for mating with the barb, the post has a reinforcement rib, a distal end of the socket has a first connecting piece, and a distal end of the second fastener has a second connecting piece.

5. The buckle according to claim 4, wherein a first elongate hole is formed between the first connecting piece and the rear wall, a second elongate hole is formed between the second connecting piece and the connecting wall, a pair of guiding grooves is formed on the inner surfaces of the upper wall and the lower wall of the socket, the stopping strips are formed on both sides of the pushing portion, the stopping strip and the pushing portion form a mounting groove, the stopping strip is formed on the upper surface and the lower surface of the stopper to correspond to the guiding groove, two push buttons are mounted on the socket, two elastic pieces are symmetrically mounted in the socket, and two accommodating troughs are symmetrically formed on the locking piece for receiving the elastic pieces.

* * * * *